US006472603B1

(12) United States Patent
Inoue

(10) Patent No.: US 6,472,603 B1
(45) Date of Patent: Oct. 29, 2002

(54) WEAK CURRENT WIRE

(75) Inventor: Yoshio Inoue, Shizuoka (JP)

(73) Assignee: Tomoegawa Paper Co., Tokyo (JP)

( * ) Notice: Subject to any disclaimer, the term of this patent is extended or adjusted under 35 U.S.C. 154(b) by 0 days.

(21) Appl. No.: 09/806,870

(22) PCT Filed: Oct. 12, 1999

(86) PCT No.: PCT/JP99/05607

§ 371 (c)(1),
(2), (4) Date: Apr. 5, 2001

(87) PCT Pub. No.: WO00/22630

PCT Pub. Date: Apr. 20, 2000

(30) Foreign Application Priority Data

Oct. 12, 1998 (JP) ..... 10-303228
Sep. 24, 1999 (JP) ..... 11-270286

(51) Int. Cl.[7] ..... H01B 7/18
(52) U.S. Cl. ..... 174/121 R; 174/124 R
(58) Field of Search ..... 174/102 SC, 106 SC, 174/107, 122 R, 124 R, 36, 121 R

(56) References Cited

U.S. PATENT DOCUMENTS 3,681,515 A * 8/1972 Mildner ..... 156/54
4,256,921 A * 3/1981 Bahder ..... 174/102 D
5,744,756 A 4/1998 Springer et al.
6,013,376 A * 1/2000 Yenni, Jr. ..... 428/174

FOREIGN PATENT DOCUMENTS

JP 61098781 A * 5/1986
JP 5-290643 11/1993
JP 10-50144 2/1998

* cited by examiner

*Primary Examiner*—Chau N. Nguyen
(74) *Attorney, Agent, or Firm*—McDermott, Will & Emery

(57) ABSTRACT

A weak current wire not susceptive to external electromagnetic waves, lightweight, having a relatively small outer diameter, and applicable to electromagnetic wave shield communication cables and non-underground communication cables not radiating electromagnetic waves externally, such as signal cables, control cables and wire harnesses.

The weak current wire according to the present invention is one selected from non-underground communication cables, subscriber lead-in telephone cables, signal cables, control cables and wire harnesses including cables for communication, signal and control and is characterized in that around a cable conductor, paired telephone wires or a wire harness, an electromagnetic wave shield layer of a porous sheet made by making an unsintered metallic fiber sheet from a slurry containing metallic fibers by a paper machine and pressing the unsintered metallic fiber sheet or made by making a metallic fiber sheet from a slurry containing metallic fibers by a paper machine and sintering the metallic fiber sheet is provided. The porous sheets may be impregnated with a thermosetting conductive adhesive.

21 Claims, 2 Drawing Sheets

WEAK CURRENT WIRE

TECHNICAL FIELD

The present invention mainly relates to a so-called weak current wire such as a non-underground communication cable, a subscriber lead-in telephone cable, i.e., an overhead communication cable, a wire within a building or paired telephone wires used in a personal house, a signal cable, a control cable, a wire harness for aircraft, or a wire harness for motor car.

BACKGROUND ART

In order to make telephone conversation clear, communication cables (telephone cables) require to have such characteristics that (1) transmission loss lessens, (2) crosstalk lessens, (3) transmission frequency has a certain range and (4) they are hard to be susceptive to external induction.

In order to achieve this object, no problem arises as to external induction in the case of an underground distribution method because complete shielding is provided. However, since its laying cost is as expensive as 5 to 10 times compared with an overhead distribution method, the overhead distribution method has been used in no small numbers. However, the overhead distribution method is susceptive to influence of induction, temperature change or the like and offers a problem by the proximity to or crossing with a power line. In addition, such complete shielding as in an underground cable is not made in a house wire, personal paired telephone wires for subscriber or the like, and so it is affected by electromagnetic waves generated from a nearby power line and various electric appliances such as refrigerators, facsimiles, televisions, personal computers and air-conditioning equipment, and talking trouble may be incurred in some cases.

In Japan, alternating electrification of respective JRs, increase in transmission capacity of general transmission lines or the like is conducted. Inductive interference against communication cables from such external induction sources becomes a problem. Induction includes electrostatic induction and electromagnetic induction. The electrostatic induction is induction from voltage from a power line or the like, and the electromagnetic induction is induction by a magnetic flux made by an electric current. In order to shield the electrostatic induction, it is only necessary to earth a metal sheath that a cable has, and it has heretofore scarcely become a problem. However, the influence thereof has come to be nonnegligible in communication devices having no shield, such as lead-in wires, with the build-up of transmission voltage in recent years.

The electromagnetic induction is then considered. It is only necessary to lengthen isolation from a power line and shorten a distance being in parallel. Even on the communication cable side, a member low in both earthing resistance and electric resistance is used as a shielding member (for earthing) to make an electric current (electric current acting in a direction negating induction voltage to a cable conductor from the power line) flowing in the cable shielding member high, thereby negating external induction to the cable conductor. In order to make induction voltage to the cable conductor high by the electric current flowing in the cable shielding member, it is necessary to make the magnetic permeability of the shielding member high so as to enlarge a magnetic flux by the electric current.

Cables equipped with the former cable shielding member, through which a high electric current flows, include cables longitudinally provided with an aluminum tape along a cable conductor and aluminum-coated cables, and a steel band sheath is considered as the latter shielding member capable of making the magnetic permeability high. In order to completely shield a cable conductor by these shield members, however, the cable conductor must be coated cylindrically with the prescribed metal, and so the outer diameter and weight of the resulting cable are increased, and the flexibility thereof becomes poor. Therefore, such a cable may be not preferable in some cases. In particular, taking the influence of recent electromagnetic wave environment on communication cables into consideration, there is an eager demand for appearance of a cable shield (including shield for lead-in paired wires) which is simple and rich in flexibility and does not cause communication trouble.

Further, signal cables, control cables, wire harnesses for aircraft or motor car are only slightly affected by external electromagnetic waves, and no problem arise thereon in an ordinary case. However, it is considered that electromagnetic waves radiated by themselves may affect various measuring instruments or electronic apparatus such as monitors. Therefore, a shield for preventing radiation of electromagnetic waves is required thereof. However, such a cable has heretofore been often used without providing any particular shield. When a shield is required, it is considered that a metal tube or braided shield is used like general communication cables. However, even in this case, the same problems as described above arise on shielding. Accordingly, it goes without saying that the cable shield which is simple and rich in flexibility and does not cause communication trouble is preferred.

As a shield layer for achieving the above object, no established shield flexible, lightweight and having a small outer diameter has heretofore existed. For example, in the case where a cable conductor is a coaxial line, a vinyl coating is provided as needed, and an Aldrey or iron wire-braided armor is provided.

This braid is very troublesome in production, a special braider must be provided, and production rate is also slow. Therefore, it involves a problem that its cost becomes high. It is also considered that a laminate tape of a metal and a plastic is wound. However, flexibility becomes poor in the case of longitudinal covering, and the thickness thereof is greater compared with paper, and so increase in outer diameter has been unavoidable.

DISCLOSURE OF THE INVENTION

The present invention solves the above-described problems.

Incidentally, the non-underground communication cables are defined as including subscriber lead-in telephone cables in the present specification. The cable conductors are also defined as including paired telephone wires.

A weak current wire according to a first aspect of the present invention is a communication cable or weak current wire selected from non-underground communication cables, signal cables, control cables and wire harnesses including cables for communication, signal and control, which is characterized in that around a cable conductor or a wire harness, an electromagnetic wave shield layer of a porous sheet made by making a metallic fiber sheet from a slurry containing metallic fibers by a paper machine and sintering the metallic fiber sheet is provided.

In the weak current wires according to the first aspect of the present invention, the electromagnetic wave shield layer may be provided through an adhesive layer around the cable conductor or the wire harness. Further, dot-like fine through-holes may be provided in the adhesive layer.

A weak current wire according to a second aspect of the present invention is a weak current wire selected from non-underground communication cables, signal cables, control cables and wire harnesses including cables for communication, signal and control, which is characterized in that around a cable conductor or a wire harness, an electromagnetic wave shield layer of a porous sheet made by making an unsintered metallic fiber sheet from a slurry containing metallic fibers by a paper machine and impregnating or filling the unsintered metallic fiber sheet with a thermosetting conductive adhesive, or of a laminated porous sheet made by laminating a thermosetting conductive adhesive layer on at least one side of the unsintered metallic fiber sheet is provided.

A weak current wire according to a third aspect of the present invention is a weak current wire selected from non-underground communication cables, signal cables, control cables and wire harnesses including cables for communication, signal and control, which is characterized in that around a cable conductor or a wire harness, an electromagnetic wave shield layer of a porous sheet made by making a metallic fiber sheet from a slurry containing metallic fibers by a paper machine, sintering the metallic fiber sheet and impregnating or filling the sintered metallic fiber sheet with a thermosetting conductive adhesive, or of a laminated porous sheet made by laminating a thermosetting conductive adhesive layer on at least one side of the sintered metallic fiber sheet is provided.

In the weak current wires according to the second and third aspects of the present invention, a rubber component may be contained in the thermosetting conductive adhesive. Further, a rubber component and an antioxidant may be contained in the thermosetting conductive adhesive.

In the weak current wires according to the first to third aspects of the present invention, specific examples of the weak current wires include (1) a weak current wire wherein the metallic fiber sheet is made of metallic fibers having a fiber length of 1 to 10 mm and a fiber diameter of 1 to 20 $\mu$m, and has a basis weight of 30 to 500 g/m$^2$, (2) a weak current wire wherein the metallic fiber sheet has voids of 50 to 93%, (3) a weak current wire wherein the non-underground communication cable is an overhead communication cable, (4) a weak current wire wherein the non-underground communication cable is a coaxial line, (5) a weak current wire wherein the wire harness is either a wire harness for aircraft or a wire harness for motor car, and (6) a weak current wire wherein the electromagnetic wave shield layer of the porous sheet is made by dispersing conductive metallic fine powder or magnetic metallic powder in metallic fibers and subjecting the resultant dispersion to sheet making.

According to the present invention, there can be provided cables not susceptive to external electromagnetic waves by using a shield, which is simple without using any complete shielding member such as, for example, a copper pipe, thin like paper and obtained without adopting any inefficient production method such as braiding, in communication cables and other weak current wires. In some cases, some signal cables, control cables and wire harnesses may affect measuring instruments or electronic apparatus such as image monitors by radiating electromagnetic waves to the outside. According to the present invention, however, a shielding effect can be achieved with relative ease by providing the shield used in the present invention on the outsides of these signal cables, control cables and wire harnesses while lessening increase in weight and volume.

BEST MODE FOR CARRYING OUT THE INVENTION

Figure 1:
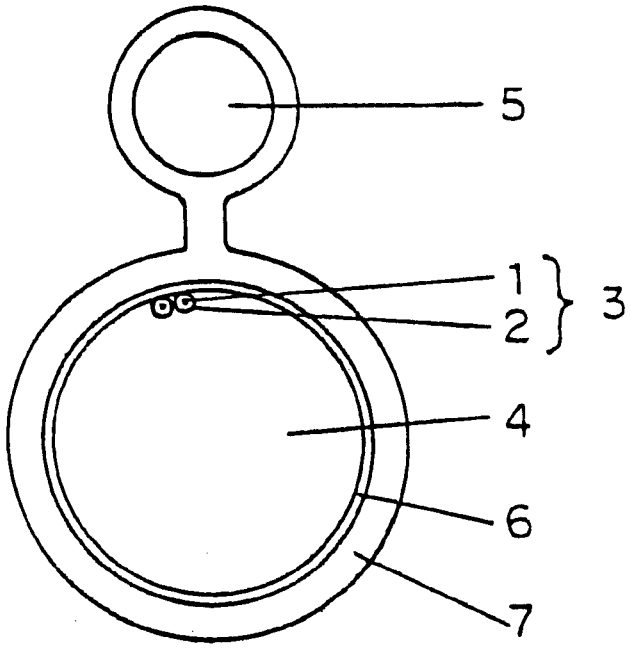
FIG. 1 is a cross-sectional view of an example of the present invention.

The present invention will hereinafter be described with reference to the drawings. FIG. 1 is a schematic cross-sectional view of an overhead communication cable in which a subsidiary wire (messenger wire) is provided separately from a cable. A cable conductor 4 and a subsidiary wire 5 made of a stranded steel wire are arranged in parallel with each other and integrated by a common sheath 7 made of black polyethylene or a vinyl chloride resin. In this drawing, the cable conductor 4 is constructed by equally twisting 2 core wires made by coating a conductor 1 with polyethylene 2 to form a pair 3 and uniting a prescribed number of the pairs. Incidentally, it goes without saying that the construction of the pair may be changed to a DM quad, star quad or the like. A required number of the pairs or quads is collected to twist them, thereby forming the cable conductor.

There are various structures in a coupling structure between the cable conductor 4 and the subsidiary wire 5. The structure illustrated in FIG. 1 is such that the subsidiary wire 5 and the cable conductor 4 are integrated by the common sheath 7 made of block polyethylene, a vinyl chloride resin or the like, and is known as an SS cable. As other structures than this, there are a band roughly wound, self-supporting type that polyethylene or vinyl chloride resin sheaths are separately provided on a cable conductor and a subsidiary wire, the subsidiary wire is wound around a cable (that obtained by providing the sheath on the cable conductor) or provided along the cable to coat them with polyethylene, and zinc-plated iron band is roughly wound around the coated cable, and a string wound, self-supporting type that a subsidiary wire is provided along a cable, and a polyethylene- or vinyl chloride resin-coated, zinc-plated iron wire is wound around them. However, it goes without saying that the present invention may be applied to any of them.

The feature of the present invention is that an electromagnetic wave shield layer 6 which is composed of a porous sheet made by making an unsintered metallic fiber sheet from a slurry containing metallic fibers by a paper machine followed wet process and pressing the unsintered metallic fiber sheet, or a porous sheet made by sintering the metallic fiber sheet is provided around the cable conductor 4 (inside the sheath) in each of the above-described self-supporting overhead communication cables. A cable sheath 7 is provided outside the coated cable conductor, thereby mechanically protecting the cable.

Figure 2:
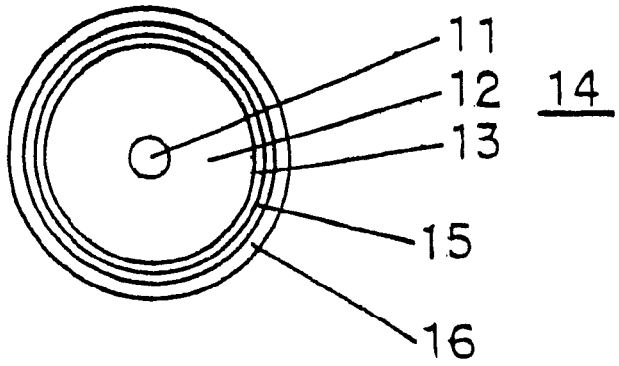
FIG. 2 is a cross-sectional view of another example of the present invention, and FIGS. 3(*a*)–(*e*) are

FIG. 2 illustrates an example of a coaxial line that a coaxial conductor is used in place of the cable conductor of an ordinary cable. An insulating material 12 of foamed polyethylene or the like around an inner conductor 11, an outer conductor 13 is further provided to form a coaxial line 14, a polyethylene sheath 15 is provided around the coaxial line. Further, an electromagnetic wave shield layer 16 of a porous sheet made by making an unsintered metallic fiber sheet from a slurry containing metallic fibers by a paper machine and pressing the unsintered metallic fiber sheet or made by sintering the metallic fiber sheet is provided around the sheath. As needed, a polyethylene sheath is further provided around the shield layer to provide a coaxial cable for communication. Incidentally, the electromagnetic wave shield layer may be provided either in a form of an SS cable together with a subsidiary wire (not illustrated) as illustrated in FIG. 1 or in another self-supporting type. However, it is necessary to exert no influence on the coaxial structure.

Incidentally, in the above-described coaxial cable, the polyethylene sheath is provided between the outer conductor 13 and the electromagnetic wave shield layer 16. However, it goes without saying that a tape may be used in place of this polyethylene sheath. To the cable sheath, may be applied an alpeth, a stalpeth or a laminate sheath formed by a film having a metal foil, metallized paper or metal-deposited film and a plastic film.

Although not particularly illustrated, the electromagnetic wave shield layer used in the present invention is provided as a shield on a wire within a building, whereby a shielding effect can be achieved without impairing flexibility. It goes without saying that even in a subscriber lead-in telephone cable, the electromagnetic wave shield layer used in the present invention is provided thereon, whereby the resulting cable becomes hard to be susceptive to electromagnetic wave interference from power lines and various electric appliances.

In the case of a signal cable, it is only necessary to provide an electromagnetic wave shield layer of a porous sheet made by making an unsintered metallic fiber sheet from a slurry containing metallic fibers by a paper machine and pressing the unsintered metallic fiber sheet or of a porous sheet made by sintering the metallic fiber sheet around a cable conductor thereof, and provide a cable sheath thereon, thereby mechanically protecting the electromagnetic wave shield layer.

Figure 3:
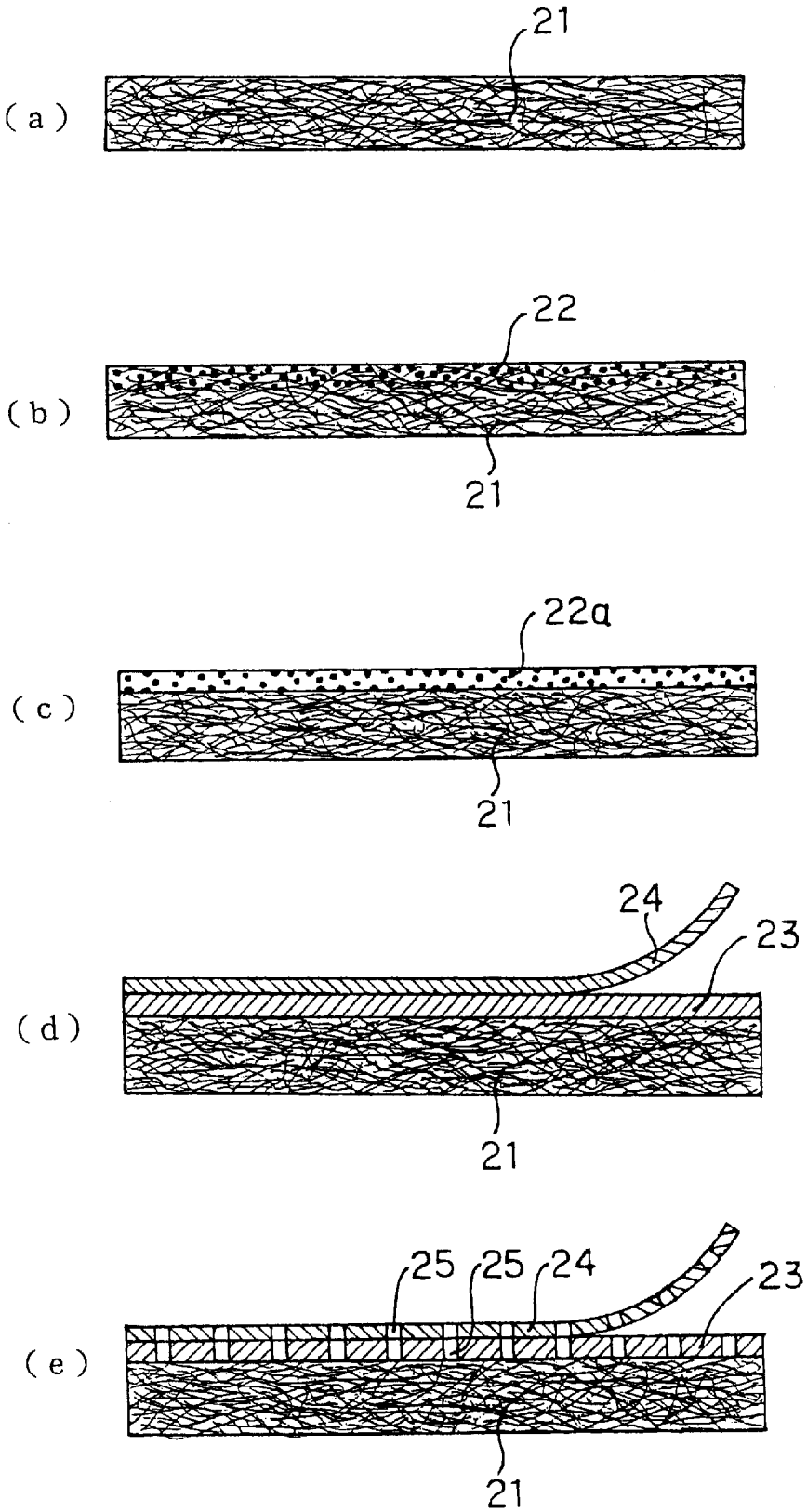
FIG. 3 is an enlarged cross-sectional views of a porous sheet used in the present invention.

In such a manner, the radiation of electromagnetic waves from the signal cable itself can be prevented to prevent communication cables, measuring instruments and/or described porous sheet with a thermosetting conductive adhesive 22. FIG. 3(*c*) illustrates a laminated porous sheet obtained by laminating a thermosetting conductive adhesive layer 22*a* on at least one side of the porous sheet.

FIG. 3(*d*) illustrates a laminate obtained by providing an adhesive layer 23 on one side of the porous sheet formed of the metallic fiber sheet 21 illustrated in FIG. 3(*a*) and providing a release sheet 24 thereon. Since the adhesive layer in this case serves to ensure adhesion between the porous sheet and a cable conductor when the porous sheet is wound around or longitudinally provided along the cable conductor, any material may be generally used therefor so far as it has proper tackiness such as pressure sensitivity or heat sensitivity. The release sheet 24 is released as illustrated in FIG. 3(*d*) when the porous sheet is wound around or longitudinally provided along the cable conductor to form an electromagnetic wave shield layer.

FIG. 3(*e*) illustrates a porous sheet in which dot-like fine through-holes 25 have been provided in the adhesive layer 23 and the release sheet 24. The reason why these fine through-holes are provided is that air permeability (porosity) is ensured in the adhesive layer adjacent to the electromagnetic wave shield layer wound around or longitudinally provided along the cable conductor. For example, when the wire harness according the like prevent about it from being affected by the electromagnetic waves. The same applies to a control cable.

Incidentally, a wire harness for aircraft or motor car is generally constructed by a wire bundle including wires for a low tension circuit, a communication circuit, a control circuit and a measuring circuit. An electromagnetic wave shield layer of a porous sheet made by making an unsintered metallic fiber sheet from a slurry containing metallic fibers by a paper machine and pressing the unsintered metallic fiber sheet or of a porous sheet made by sintering the metallic fiber sheet can be provided around the bundle, thereby preventing the influence of electromagnetic waves radiated therefrom.

The porous sheet made from the metallic fiber sheet. used in the present invention will hereinafter be described.

FIG. 3 is an enlarged cross-sectional view thereof. FIG. 3(*a*) illustrates a metallic fiber sheet made from a slurry containing metallic fibers by a paper machine, which is a porous sheet obtained by pressing the metallic fiber sheet in an unsintered state or by sintering the metal fiber sheet. This porous sheet is formed of a metal fiber layer 21 and has a structure similar to paper. A porous sheet having a thickness of 20 to 300 $\mu$m is generally used. FIG. 3(*b*) illustrates a porous sheet obtained by impregnating or filling one side of the above to the present invention is installed in an aircraft, an effect of facilitating the escaping of dew drops occurred due to a temperature difference between the ground and the sky is developed.

On the other hand, as with the adhesive layer, the thermosetting conductive adhesive illustrated in FIGS. 3(*b*) and 3(*c*) serves to ensure adhesion between the porous sheet and a cable conductor when the porous sheet is wound around or longitudinally provided along the cable conductor. Therefore, the adhesive must maintain a B stage (semicured state) in a stage of the porous sheet. Accordingly, when the porous sheet illustrated in FIG. 3(*b*) or 3(*c*) is used, a heating and curing step is required after it is wound around or longitudinally provided along the cable conductor.

In the present invention, such a porous sheet as described above is longitudinally provided along or laterally wound around a communication cable, signal cable, control cable or wire harness to form an electromagnetic wave shield layer. In this case, conductive metallic fine powder or magnetic metallic particles may be contained in the electromagnetic wave shield layer.

Examples of the metallic fibers used in the present invention include stainless steel fibers, titanium fibers, nickel fibers, brass fibers, copper fibers and aluminum fibers. In the case of shielding in a high frequency region, a high-conductive material is used because an electric field mainly becomes a problem. In the case of shielding in a low frequency region, a high-permeability material such as an amorphous alloy or Permalloy is used because a magnetic field mainly becomes a problem. Stainless steel fibers are most preferred from the viewpoints of fine line processing, heat resistance, rust resistance and magnetic wave shielding effect.

The metallic fibers have a fiber diameter of 1 to 20 $\mu$m, preferably 4 to 10 $\mu$m and a fiber length of 1 to 10 mm, preferably 2 to 6 mm. As binding fibers, are preferred, for example, easily water-soluble polyvinyl alcohol fibers having a solubility temperature of 40 to 100° C. in water.

In the present invention, the porous sheet is used in two practical methods that the metallic fiber sheet made by the paper machine is used in an unsintered state as it is and that the metallic fiber sheet is used after subjecting it to a sintering treatment. In the case where the metallic fiber sheet is used in the unsintered state as it is, a binder such as polyvinyl alcohol remains in the sheet. Therefore, when such a porous sheet is wounded around or longitudinally provided along the cable conductor as it is, the porous sheet is too high in electric resistance, and so it interfere with the electromagnetic wave-shielding property thereof.

Accordingly, it is necessary to subject the metallic fiber sheet obtained by the paper machine to a pressing treatment by pressing rollers or the like to increase the density of the sheet from 0.7 to 0.8 g/cm$^3$ (untreated) to 1.5 to 2.0 g/cm$^3$ (treated) so as to increase contact points among the fibers. In addition, when the porous sheet is used in the unsintered state as it is, it is necessary to decrease the amount of the binder in the metallic fiber sheet from 10% by weight in an ordinary case to at most 5% by weight or change the metallic fibers from those having a fiber length of 3 to 5 mm in an ordinary case to those having a fiber length of 7 to 8 mm in order to lower the electric resistance thereof as much as possible.

On the other hand, when the latter sintered metallic fiber sheet is used, the sintering temperature is a temperature near the melting point of the metallic fibers, for example, about 1,200° C. in the case of stainless steel fibers. When the stainless steel fibers are sintered in a continuous sintering furnace, they can be sintered at a linear velocity of 100 to 700 mm/min and about 1,200° C. The sintering may be conducted in a mixed gas atmosphere of, for example, nitrogen gas and argon gas. The metallic fibers are electrically conducted among one another by this sintering to have the advantage of good earthing.

In the present invention, those in which no thermosetting conductive adhesive is used have a merit that heat-radiating property becomes good. On the other hand, those in which a thermosetting conductive adhesive is used facilitate the electric conduction among the metallic fibers and are useful in earthing. In addition, such a sheet adhere when it is longitudinally provided along or wound around the cable, and so the covering is easily conducted, and an electromagnetic wave-absorbing effect can also be exhibited.

Further, a different kind of a metal such as Cu, Ni, Au, Pt or Ag may be electroplated or nonelectrolytically plated on the fiber surface of the metal fiber layer, thereby heightening the electrical conductivity thereof.

The thermosetting conductive adhesive applied to the porous sheet according to the present invention will hereinafter be described.

The thermosetting conductive adhesive impregnated or filled into the metallic fiber sheet or the sintered sheet thereof or laminated as an adhesive layer contains a rubber component and a binder resin and comprises an antioxidant and a conductive filler as needed.

As the rubber component, may be used any of synthetic rubber and natural rubbers such as acrylonitrile-butadiene copolymer rubber (NBR), styrene-butadiene rubber (SBR), butadiene rubber (BR), ethylene-propylene rubber (EPM, EPDM), acrylic rubber (ACM, ANM) and urethane rubber (AU, EU). Among others, the acrylonitrile-butadiene copolymer rubber (NBR) is preferred from the viewpoints of physical properties after vulcanization, i.e., good freeze resistance, oil resistance, aging resistance, abrasion resistance and shock-absorbing property, and low cost. As the acrylonitrile-butadiene copolymer, that having a molecular weight of 50,000 to 1,000,000, preferably 100,000 to 500,000 is used. When the binder resin is used, a thermosetting type resin such as an epoxy resin, phenol resin or polyimide resin is preferred.

In particular, 20 to 500 parts by weight of the binder resin is blended with 100 parts by weight of the acrylonitrile-butadiene copolymer as the rubber component, whereby an adhesive having proper hardness and adhesion is obtained. If the amount of the binder resin is less than 20 parts by weight, the adhesion property of the resulting composition becomes insufficient. If the amount of the binder resin exceeds 500 parts by weight, the rubber component becomes too little, and the resulting composition becomes too hard. It is hence not preferable to blend the binder resin in such a too little or great amount.

The conductive filler may be added for the purpose of imparting better conductivity to the thermosetting conductive adhesive. As the conductive filler, may be used powder of a metal such as Au, Pt, Pd, Ag, Cu or Ni, or conductive carbon black, graphite or a mixture thereof. Magnetic particles such as nickel particles or ferrite particles may be mixed to take a measure against shielding of a magnetic field. The content of the conductive filler used is preferably 1 to 100 parts by weight per 100 parts by weight of the total amount of the rubber component and the binder component. If the content of the conductive filler is lower than 1 part by weight, the effect of the conductive filler added becomes insufficient. If the content is higher than 100 parts by weight, the conductive filler is hard to be impregnated into the metallic fiber layer.

In order to impart flame retardancy, any publicly known substance may be used. However, a hydrate of alumina or magnesia is preferred from the viewpoint of no environmental pollution.

A hardening agent may be further added to the binder. Examples of the hardening agent include imidazoles such as 2-ethyl-4(5)-methylimidazole, 1-benzyl-2-methylimidazole, 1-isobutyl-2-methylimidazole, 1-cyanoethyl-2-ethyl-4(5)-methylimidazole, 2-heptadecylimidazole, 2-methylimidazol-azine and 2-undecylimidazole.

An antioxidant is used for the purpose of preventing the rubber component and binder resin in the thermosetting conductive adhesive from undergoing oxidative deterioration by oxygen in the air to lower the quality of the adhesive. As the antioxidant, a phenolic antioxidant, sulfur-containing antioxidant or phosphorus-containing antioxidant is used. Examples of the phenolic antioxidant include 2,6-di-t-butyl-p-cresol, butylated hydroxyanisole, 2,6-di-butyl-4-hydroxyphenol, stearyl-β-(3,5-di-t-butyl-4-hydroxyphenol propionate. Examples of the sulfur-containing antioxidant include dilauryl thiodipropionate, dimyristyl thiodipropionate and distearyl thiodipropionate. Example of the phosphorus-containing antioxidant include triphenylphosphite, diphenylisodecylphosphite, phenyldiisodecylphosphite and 4,4'-butylidene-bis(3-methyl-6-t-butylphenyl-di-tridecyl) phosphite.

The content of the antioxidant is 0.1 to 100 parts by weight, preferably 1 to 100 parts by weight per 100 parts by weight of the total amount of the rubber component and the binder resin. If the content of the antioxidant is lower than 0.1 parts by weight, the antioxidant effect of the antioxidant becomes insufficient. If the content is higher than 100 parts by weight, the action of the resulting adhesive is deteriorated.

EXAMPLES

The present invention will hereinafter be described by Examples.

Preparation Examples of Porous Sheet

Preparation Example 1:

A slurry composed of 90 parts by weight of stainless steel fibers (product of TOKYO ROPE MFG. CO., LTD., SUS316L, trade name: Sasumic) having a fiber diameter of 2 μm and a fiber length of 3 mm and 10 parts by weight of polyvinyl alcohol fibers (product of KURARAY CO., LTD., Fibribond VPB105-1) having a solubility of 70° C. in water was used to make a sheet by the paper machine, thereby making a metallic fiber sheet having a thickness of 100 μm and a density of 0.8 g/cm$^3$. The metallic fiber sheet was then sintered at 800 to 1,200° C. in a hydrogen gas atmosphere to obtain a sheet. Ni was plated on this sheet to make a sheet. The tensile strength of this sheet was 6.08 kg/15 mm in length and 5.01 kg/15 mm in breadth, the porosity was 59%, and the average pore diameter was 4.1 μm. It was confirmed that the metallic fibers are bonded among one another by the sintering.

Incidentally, the tensile strength was measured by means of a TENSILON universal tensile tester (manufactured by Toyo Baldwin Co.), and the porosity and average pore diameter were measured by a Porometer (trade name) manufactured by POROUS MATERIALS CO. in accordance with the pore measuring method based on ASTM F 316-86.

A pressure sensitive adhesive sheet formed of a release sheet of a polyethylene terephthalate (PET) film having an adhesive layer having through-holes in advance as illustrated in FIG. 3(*e*) on the surface thereof and subjected to release processing with a silicone was then stuck on one side of this sheet to prepare a porous sheet.

Preparation Example 2:

The metallic fiber sheet obtained in Preparation Example 1 and having a density of 0.8 g/cm$^3$ was passed through between pressing rollers of a linear pressure of 150 Kg/cm without sintering it to obtain a sheet having a density of 1.5 g/cm$^3$.

Preparation Example 3:

A slurry composed of 90 parts by weight of stainless steel fibers (product of TOKYO ROPE MFG. Co., Ltd., SUS316L, trade name: Sasumic) having a fiber-diameter of 6 μm and a fiber length of 8 mm and 10 parts by weight of polyvinyl alcohol fibers (product of KURARAY Co., Ltd., Fibribond VPB105-1) having a solubility of 70° C. in water was used to make a sheet by the paper machine. The sheet was dehydrated by pressing and dried under heat, thereby obtaining a metallic fiber sheet having a basis weight of 76 g/m$^2$. This sheet was then calcined at 1,200° C. for 2 hours in a vacuum stove to prepare a sheet having a basis weight of 74 g/m$^2$ and a density of 0.9 g/cm$^3$.

Preparation Example 4:

A slurry composed of 60 parts by weight of stainless steel fibers (product of TOKYO ROPE MFG. CO., LTD., SUS316L, trade name: Sasumic) having a fiber diameter of 8 μm and a fiber length of 4 μm, 20 parts by weight of in copper fibers (trade name: Capron, product of Esco Co.) having a fiber diameter of 30 μm and a fiber length of 4 mm as fine conductive fibers and 20 parts by weight of polyvinyl alcohol fibers (product of KURARAY CO., LTD., Fibribond VPB105-1) having a solubility of 70° C. in water was used to make a sheet by the paper machine. The sheet was dehydrated by pressing and dried under heat, thereby obtaining a metallic fiber sheet having a basis weight of 100 g/m$^2$. This sheet was then heated and sintered under conditions of a linear pressure of 300 Kg/cm and a rate of 5 m/min by means of heated rolls having a surface temperature of 160° C. The thus press-bonded metallic fiber sheet was subjected to a sintering treatment under conditions of a heat treatment temperature of 1,120° C. and a rate of 15 cm/min by means of a continuous drying oven in a hydrogen gas atmosphere without pressing it, thereby obtaining a sheet having a basis weight of 80 g/m$^2$ and a density of 1.69 g/cm$^3$, in which the surfaces of the stainless steel fibers was covered with molten copper.

Preparation Example 5:

A slurry composed of 90 parts by weight of stainless steel fibers (product of TOKYO ROPE MFG. CO., LTD., SUS316L, trade name: Sasumic) having a fiber diameter of 8 μm and a fiber length of 4 mm and 10 parts by weight of polyvinyl alcohol fibers (product of KURARAY CO., LTD., Fibribond VPB105-1-3) having a solubility of 70° C. in water was used to make a sheet by the paper machine. The sheet was then dehydrated by pressing and dried under heat, thereby obtaining a metallic fiber sheet A having a basis weight of 110 g/m$^2$. Stainless steel fibers having a fiber diameter of 4 μm and a fiber length of 4 mm were then used to obtain a metallic fiber sheet B in the same manner as described above. Similarly, stainless steel fibers having a fiber diameter of 2 μm and a fiber length of 3 mm were used to obtain a metallic fiber sheet C in the same manner as described above. The metallic fiber sheets A, B and C were separately sintered at a sintering temperature of 1,120° C. and a rate of 15 cm/min by means of a continuous stove in a hydrogen gas atmosphere to form sintered sheets. These sheets were superimposed on one another in order and sintered again at a sintering temperature of 1,120° C. and a rate of 3 m/min by means of the continuous stove in a hydrogen gas atmosphere to obtain a sheet having an inclined structure of pore diameter corresponding to the relationship of A>B>C.

Preparation Example 6:

A slurry composed of 90 parts by weight of stainless steel fibers (product of TOKYO ROPE MFG. CO., LTD., SUS316L, trade name: Sasumic) having a fiber length of 4 mm and a fiber diameter of 8 μm and 10 parts by weight of polyvinyl alcohol fibers (product of KURARAY CO., LTD., Fibribond VPB105-1-3) having a fiber length of 3 mm and a solubility of 70° C. in water was used to make a sheet by the paper machine. The sheet was dried and them made into a metallic fiber sheet having a basis weight of 84 g/m$^2$. This sheet was sintered under conditions of a sintering temperature of 1,180° C. and a sintering time of 20 minutes by means of a stove in a reducing hydrogen atmosphere to obtain a sintered porous metallic fiber sheet having a density of 1.1 g/cm$^3$. Gold was plated on this sheet under the following conditions to obtain a sheet used in the present invention. A pressure sensitive adhesive sheet was stuck on this sheet in the same manner as in Preparation Example 1 to obtain a porous sheet.

Current density: 5.0 A/dm$^2$

Electrolytic cell: K24EA30 (manufactured by High Purity Chemicals Co., Ltd.)

Treatment temperature: 40° C.

Anode: platinum-plated titanium plate

Incidentally, any publicly known plating means may be chosen for use in the plating of the metallic fibers. The plating may be optionally conducted either in the stage of fibers or in the stage that the sheet has been made. The toughness of the stainless steel fibers used in the present invention is not lowered by the plating, and the conductivity can be enhanced according to the kind of the metal plated.

The metallic fiber sheet thus obtained had voids of 86% and an average pore diameter of 30 μm, Preparation Example 7:

A thermosetting conductive adhesive having the following formulation was dispersed in a mixed solvent of 400 parts by weight of methyl ethyl ketone and 100 parts by weight of methyl isobutyl ketone, and this dispersion was applied to the same releasing PET film as that used in Preparation Example 1 and heated at 140° C. for 3 minutes in a drier with internal air circulation so as to become a heat-cured state of B stage, thereby obtaining a film of a rubber component-containing thermosetting conductive adhesive. The amount of the dispersion applied was controlled so as to give a thickness of 30 μm after drying of the adhesive.

Bisphenol A type resol phenol resin 60 parts by weight

Acrylonitrile-butadiene copolymer 40 parts by weight

Antioxidant 1 part by weight

Conductive carbon black 50 parts by weight

On the other hand, a slurry composed of 75 parts by weight of stainless steel fibers (product of TOKYO ROPE MFG. CO., LTD., SUS316L, trade name: Sasumic) having a fiber diameter of 8 μm and a fiber length of 5 mm and 25 parts by weight of binding fibers (product of KURARAY CO., LTD., Kuraray Vinylon Fibrid) was used to make a sheet by the paper machine, thereby making a metallic fiber sheet. This sheet was further sintered, thereby preparing a metallic fiber sheet composed of a stainless steel fiber sheet. This metallic fiber sheet had a basis weight of 50 g/m$^2$, voids of 78% and a thickness of 35 μm.

The thermosetting conductive adhesive layer on the surface of the releasing PET film was then laminated on the metallic fiber sheet at a rate of 1 m/min and a temperature of 100° C. by means of a laminator.

A porous sheet having a thermosetting conductive adhesive layer used in the present invention was obtained by this process.

It goes without saying that when the amount of the solvent is increased for the purpose of impregnating the porous sheet with a part of the thermosetting conductive adhesive, the impregnation can be conducted with ease.

As the acrylonitrile-butadiene copolymer, a copolymer (product of Nippon Zeon Co. Ltd., trade name: NIPOL1001) having an Mw of 62,000 and a ratio of Mw/Mn of 12.29 was used. As the bisphenol A type resol phenol resin, a product (trade name: CKM-908) of SHOWA HIGHPOLYMER CO., LTD. was used. As the antioxidant, tetraester type high-molecular weight hindered phenol [tetrakis [methylene-3-(3',5'-di-t-butylhydroxyphenol) propionate]methane] (product of ASAHI DENKA KOGYO K.K., trade name: Adekastab AO-60) was used. As the conductive carbon black, acetylene black (oil absorption: 125 ml/100 g, product of DENKI KAGAKU KOGYO KABUSHIKI KAISHA, trade name: Denkablack HS-100) was used.

Preparation of Electromagnetic Wave Shield Communication Cable and Evaluation The porous sheets obtained in Preparation Example 1 and Preparation Examples 3 to 7 were separately slit into prescribed widths to work them in the form of a tape. Local CCP cables (conductor diameter: 0.4 mm, PE thickness: 0.13 mm, 10-paired cables) used in local telephone lines were then produced. At this time, such a tape as shown in Preparation Examples of the present invention was longitudinally provided along a cable conductor to form an electromagnetic wave shield layer, and a polyethylene sheath was provided thereon to make cables according to the present invention on an experimental basis. As comparative examples, a comparative cable A having no shield, a comparative cable B in which a shield was provided by longitudinally providing an aluminum tape of 0.2 mm in accordance with the conventional technique, and a polyethylene sheath was provided thereon and a comparative cable C in which a shield of a conductor braid was provided, and a polyethylene sheath was provided thereon were made on an experimental basis.

Each of the thus-obtained cables according to the present invention and the comparative cables A, B and C was held under tension at an about 10-m portion of the whole length of 250 m, and a single conductor cable of a 600-V chloroprene cabtire cable (nominal sectional area: 2.0 mm$^2$) was crossed at an interval of about 1 mm at a midway thereof to investigate the quality of talking in each of the cables. As a result, crosstalk was observed in the comparative cable A, but not crosstalk was observed in the cables according to the present invention, and talking could be clearly made. No crosstalk was observed in both comparative cables B and C having the shield.

Those provided with a shield of the metal fiber tape according to the present invention are lightweight, small in outer diameter, easy to produce and also cheap in cost. In addition, such a shield has a thickness like paper compared with the aluminum tape in Comparative Example B. Therefore, the resulting cable is small in outer diameter, lightweight and flexible. The metallic fiber tape can be wound to say nothing of longitudinal covering thereof. The resulting cable has good flexibility. The cables according to the present invention have merits that they are lightweight and small in diameter compared with the conductor braid cable of Comparative Example C and their production efficiency is good because no braiding step is required, and so the cost is low. In the tapes impregnated with the thermosetting conductive adhesive or laminated by the thermosetting conductive adhesive layer, they are useful in prevention of electromagnetic waves in cooperation with the metallic fibers because they have an electromagnetic wave-absorbing effect. Incidentally, those having the thermosetting conductive adhesive layer are effective in that they completely cover because they are not frayed when a shield is provided after the fact like a wire harness.

When the tape prepared in Preparation Example 7 is used, it is only necessary to wind it around a cable conductor and then heated at 150° C. for 5 minutes to cure the thermosetting conductive adhesive layer so as to be bonded. Therefore, the electromagnetic wave shield layer can be easily provided on a cable conductor.

INDUSTRIAL APPLICABILITY

According to the porous sheets used in the present invention, shielding materials effective from high frequency to low frequency can be provided according to a metallic fiber material used, and so an electrostatic shielding effect and besides an electromagnetic shielding effect can be exhibited according to the kind of the metal used. When stainless steel fibers are used in particular, various shielding materials different in electromagnetic shielding effect from each other can be provided by selecting the kind of a material plated by utilizing the toughness thereof. Therefore, a design according to the kind of an electric wire used and an environment situated is feasible. In particular, the porous sheets obtained by impregnating or filling the sintered or unsintered metallic fiber sheet with the thermosetting conductive adhesive, or the laminated porous sheets obtained by laminating the thermosetting conductive adhesive layer on at least one side of each of these metallic fiber sheets can be longitudinally provided along or wound around an electric wire with ease and have an electromagnetic wave-absorbing property. Therefore, new electric cables can be provided by applying these sheets.

The present invention can provide cables useful as a measure against interference by external electromagnetic waves. More specifically, in signal cables and control cables, radiation of electromagnetic waves from the interior can be effectively prevented.

Further, the weak current wires according to the present invention can also be effectively used in wires in houses (including paired telephone wires) on which shielding has heretofore been scarcely considered. More specifically, even when the weak current wires come near to lightening, electric appliances and power lines for actuating them, the influence of electromagnetic waves from them can be eliminated. In addition, the weak current wires are rich in flexibility and hence can be wired in narrow spaces with ease.

What is claimed is:

1. A weak current wire selected form non-underground communication cables, signal cables, control cables and wire harnesses including cables for communication, signal and control, which is characterized in that around a cable conductor or a wire harness, an electromagnetic wave shield layer of a porous sheet made by making a metallic fiber sheet from a slurry containing metallic fibers by a paper machine and sintering the metallic fiber sheet is provided, wherein said metallic fiber sheet is made of metallic fibers having a fiber length of 1 to 10 mm and a fiber diameter of 1 to 20 $\mu$m, and has a basis weight of 30 to 500 g/m$^2$, or said metallic fiber sheet has voids of 50 to 93%.

2. The weak current wires according to claim 1, wherein the electromagnetic wave shield layer is provided through an adhesive layer around the cable conductor or the wire harness.

3. The weak current wires according to claim 2, wherein dot-like fine through-holes are provided in the adhesive layer.

4. The weak current wire according to claim 1, wherein the non-underground communication cable is an overhead communication cable.

5. The weak current wire according to claim 1, wherein the non-underground communication cable is a coaxial line.

6. The weak current wire according to claim 1, wherein the wire harness is either a wire harness for aircraft or a wire harness for motor car.

7. The weak current wire according to claim 1, wherein the electromagnetic wave shield layer of the porous sheet is made by dispersing conductive metallic fine powder or magnetic metallic powder in metallic fibers and subjecting the resultant dispersion to sheet making.

8. A weak current wire selected form non-underground communication cables, signal cables, control cables and wire harnesses including cables for communication, signal and control, which is characterized in that around a cable conductor or a wire harness, an electromagnetic wave shield layer of a porous sheet made by making an unsintered metallic fiber sheet from a slurry containing metallic fibers by a paper machine and impregnating or filling the unsintered metallic fiber sheet with a thermosetting conductive adhesive, or of a laminated porous sheet made by laminating a thermosetting conductive adhesive layer on at least one side of the unsintered metallic fiber sheet is provided, wherein said metallic fiber sheet is made of metallic fibers having a fiber length of 1 to 10 mm and a fiber diameter of 1 to 20 $\mu$m, and has a basis weight of 30 to 500 g/m$^2$, or said metallic fiber sheet has voids of 50 to 93%.

9. The weak current wire according to claim 8, wherein a rubber component is contained in the thermosetting conductive adhesive.

10. The weak current wire according to claim 8, wherein a rubber component and an antioxidant are contained in the thermosetting conductive adhesive.

11. The weak current wire according to claim 8, wherein the non-underground communication cable is an overhead communication cable.

12. The weak current wire according to claim 8, wherein the non-underground communication cable is a coaxial line.

13. The weak current wire according to claim 8, wherein the wire harness is either a wire harness for aircraft or a wire harness for motor car.

14. The weak current wire according to claim 8, wherein the electromagnetic wave shield layer of the porous sheet is made by dispersing conductive metallic fine powder or magnetic metallic powder in metallic fibers and subjecting the resultant dispersion to sheet making.

15. A weak current wire selected from non-underground communication cables, signal cables, control cables and wire harnesses including cables for communication, signal and control, which is characterized in that around a cable conductor or a wire harness, an electromagnetic wave shield layer of a porous sheet made by making a metallic fiber sheet from a slurry containing metallic fibers by a paper machine, sintering the metallic fiber sheet and impregnating or filling the sintered metallic fiber sheet with a thermosetting conductive adhesive, or of a laminated porous sheet made by laminating a thermosetting conductive adhesive layer on at least one side of the sintered metallic fiber sheet is provided, wherein said metallic fiber sheet is made of metallic fibers having a fiber length of 1 to 10 mm and a fiber diameter of 1 to 20 $\mu$m, and has a basis weight of 30 to 500 g/m$^2$, or said metallic fiber sheet has voids of 50 to 93%.

16. The weak current wire according to claim 15, wherein a rubber component is contained in the thermosetting conductive adhesive.

17. The weak current wire according to claim 15, wherein a rubber component and an antioxidant are contained in the thermosetting conductive adhesive.

18. The weak current wire according to claim 15, wherein the non-underground communication cable is an overhead communication cable.

19. The weak current wire according to claim 15, wherein the non-underground communication cable is a coaxial line.

20. The weak current wire according to claim 15, wherein the wire harness is either a wire harness for aircraft or a wire harness for motor car.

21. The weak current wire according to claim 15, wherein the electromagnetic wave shield layer of the porous sheet is made by dispersing conductive metallic fine powder or magnetic metallic powder in metallic fibers and subjecting the resultant dispersion to sheet making.

* * * * *